US006453480B1

(12) United States Patent
Yeh

(10) Patent No.: US 6,453,480 B1
(45) Date of Patent: Sep. 24, 2002

(54) SEPARATE-TYPE CISTERN HANDLE BASE MOUNT

(76) Inventor: Hsien-Min Yeh, No. 2, 16 Nong, Lane 169, Sec. 3, Chang Tsao Road, Ho-Mei Chen, Chang-Hua Hsien (TW)

( * ) Notice: Subject to any disclaimer, the term of this patent is extended or adjusted under 35 U.S.C. 154(b) by 0 days.

(21) Appl. No.: 09/934,849

(22) Filed: Aug. 23, 2001

(51) Int. Cl.[7] ..... E03D 5/00
(52) U.S. Cl. ..... 4/405; 16/110.1
(58) Field of Search ..... 4/405, 411–414; 16/110.1, DIG. 41, DIG. 30

(56) References Cited

U.S. PATENT DOCUMENTS 1,583,325 A * 5/1926 Tilden ..... 4/405
2,248,126 A * 7/1941 Schafer ..... 4/405
2,468,203 A * 4/1949 Keller ..... 4/405
2,668,961 A * 2/1954 Owens ..... 4/405
2,942,276 A * 6/1960 Meister ..... 4/405
3,278,948 A * 10/1966 Jensen ..... 4/405
5,491,848 A * 2/1996 Wang ..... 4/405
5,680,659 A * 10/1997 Gessaman ..... 4/405
6,219,884 B1 * 4/2001 Adriano ..... 4/405

* cited by examiner

*Primary Examiner*—Charles R. Eloshway
(74) *Attorney, Agent, or Firm*—Troxell Law Office PLLC

(57) ABSTRACT

A separate-type cistern handle base mount has a base mount installed onto the side wall of a cistern, a pressure control seat assembled to the front end of the base mount, and a stem inserted through the base mount and fixed at the front end of the pressure control seat. The base mount is a T-shaped anchoring structure and holds a colored decorative piece against the side wall of the cistern tank. The pressure control seat has an end cap fastened to the front end with a center hole to provide for the insertion of the stem through a passage of the base mount, the threaded hole of the sleeve fitting, and the center hole of the end cap. A set screw is fastened into the lateral wall of the end cap to secure the pressure control seat.

3 Claims, 4 Drawing Sheets

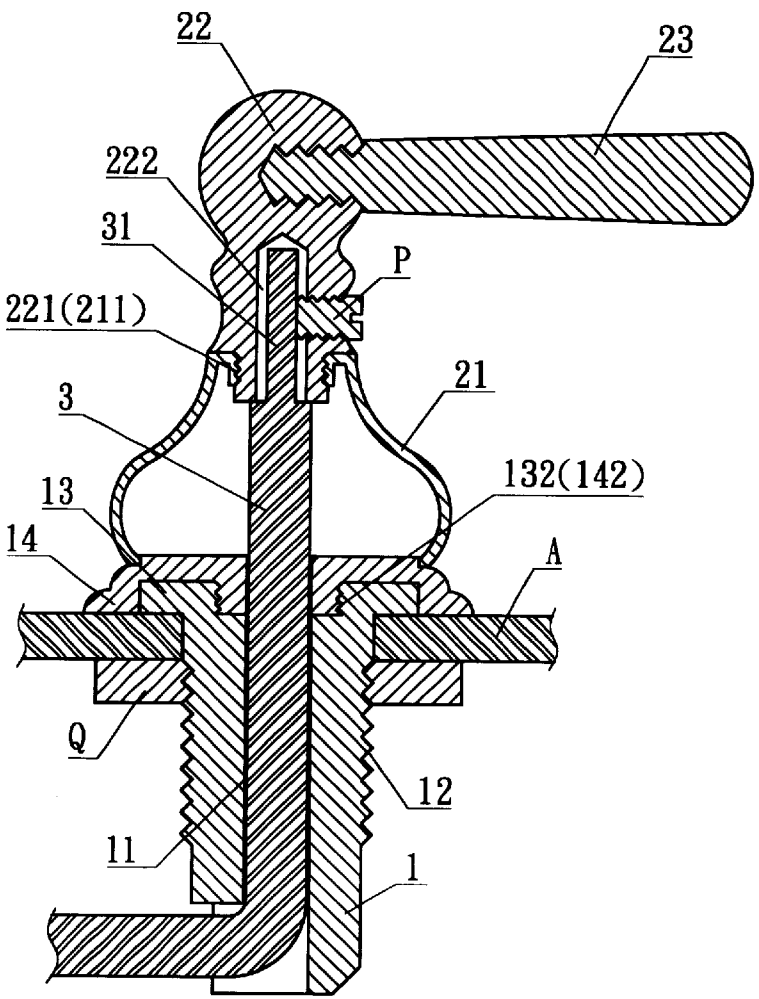
FIG4-B
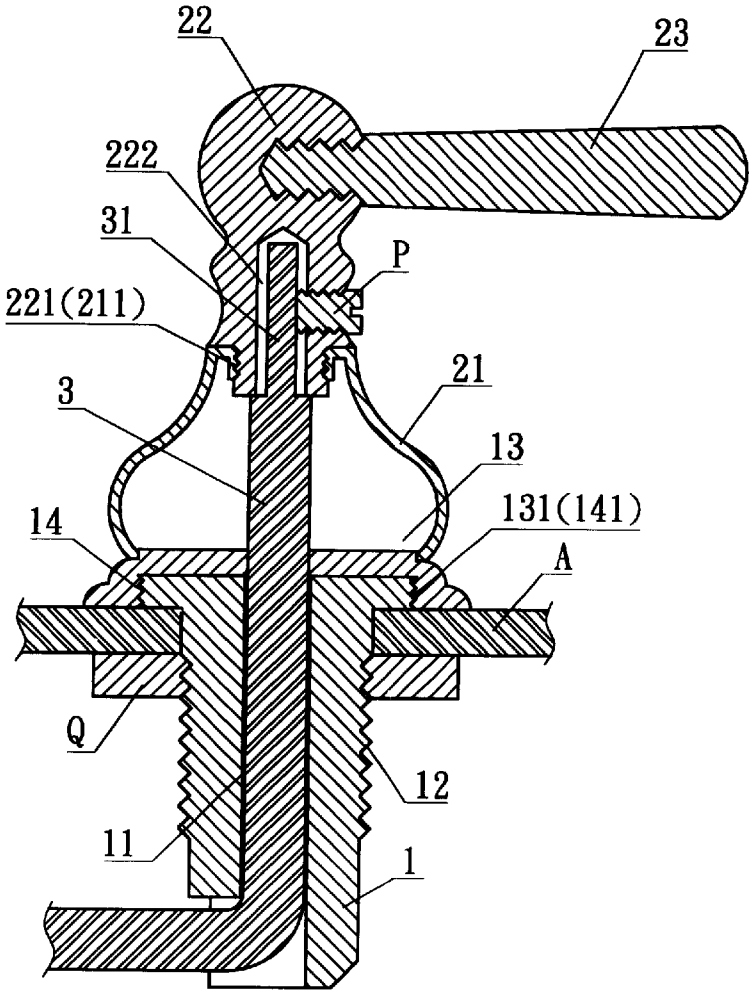
FIG4-A

SEPARATE-TYPE CISTERN HANDLE BASE MOUNT

BACKGROUND OF THE INVENTION

1) Field of the Invention

The invention herein relates to a separate-type cistern handle base mount in which the major cylindrical surface of the mount is first situated to maintain a colored decorative piece against the side wall of a cistern tank. The sleeve fitting and the colored decorative piece are tightly conjoined onto the base mount to become a structural arrangement of two or more colors.

2) Description of the Prior Art

The base mount and the pressure control seat of a conventional cistern handle base mount are individually fabricated one-piece components, an approach that results in internal section hole and threaded surface finishing difficulties resulting in high expenditure finishing costs. After fabrication, the cistern handle base mount is typically surface treated by electroplating or baked enameling, with the structural arrangement of coloration requiring the completion of a two-step electroplating process that involves the masking of the colored portions and the first application of electroplating or enameling. After drying, the masking is removed and the plated areas are masked such that only the unplated portions are exposed, following which the second application of color electroplating is executed. However, such a fabrication process is not only high in production cost, it is only capable of electroplating of simple shapes. If such fabrication difficulties are overcome by forced means, this results in very high finished product defect rates and wastes the time and energy of work personnel.

SUMMARY OF THE INVENTION

The primary objective of the invention herein is to provide a separate-type cistern handle base mount that is easy to fabricate and comprised of a base mount installed to the side wall of a cistern, a pressure control seat assembled to the front end of the base mount, and a stem inserted through the base mount and fixed at the front end of the pressure control seat. The base mount is T-shaped and, furthermore, its major cylindrical surface is first situated to maintain a colored decorative piece against the side wall of the cistern tank. A nut is fastened onto the threads of the base mount inside the cistern tank to secure the base mount and the colored decorative piece to the side wall of the cistern tank. The pressure control seat has an end cap fastened to the front end of its sleeve fitting and, furthermore, the end cap has disposed in it a center hole that is aligned with the threaded hole of the sleeve fitting to provide for the insertion of the stem through the passage of the base mount, the threaded hole of the sleeve fitting, and the center hole of the end cap, respectively. A set screw is fastened into the lateral wall of the end cap to secure the pressure control seat in position. The sleeve fitting and the colored decorative piece are tightly conjoined onto the base mount such that the invention becomes a structural arrangement of two or more colors, while also reducing production costs and defect rates and, furthermore, effectively facilitating and simplifying the fabrication process.

Another object of the invention herein is to provide a separate-type cistern handle base mount that reduces defect rates and production costs. The sleeve fitting and the colored decorative piece of the present invention are individually electroplated and then the two components are assembled into a single structural entity. The colored portions of the invention are not subject to the shortcoming of electroplating failure due to incomplete masking, thereby decreasing fabrication defect rates. Since the colored portions of the present invention do not require two applications of electroplating, this saves fabrication time, which not only further lessens defect rates, but also lowers production cost.

BRIEF DESCRIPTION OF THE DRAWINGS

FIG. 4-A is a cross-sectional drawing of a different embodiment of the invention here (1).

FIG. 4-B is a cross-sectional drawing of a different embodiment of the invention here (2).

DETAILED DESCRIPTION OF THE INVENTION

Figure 1:
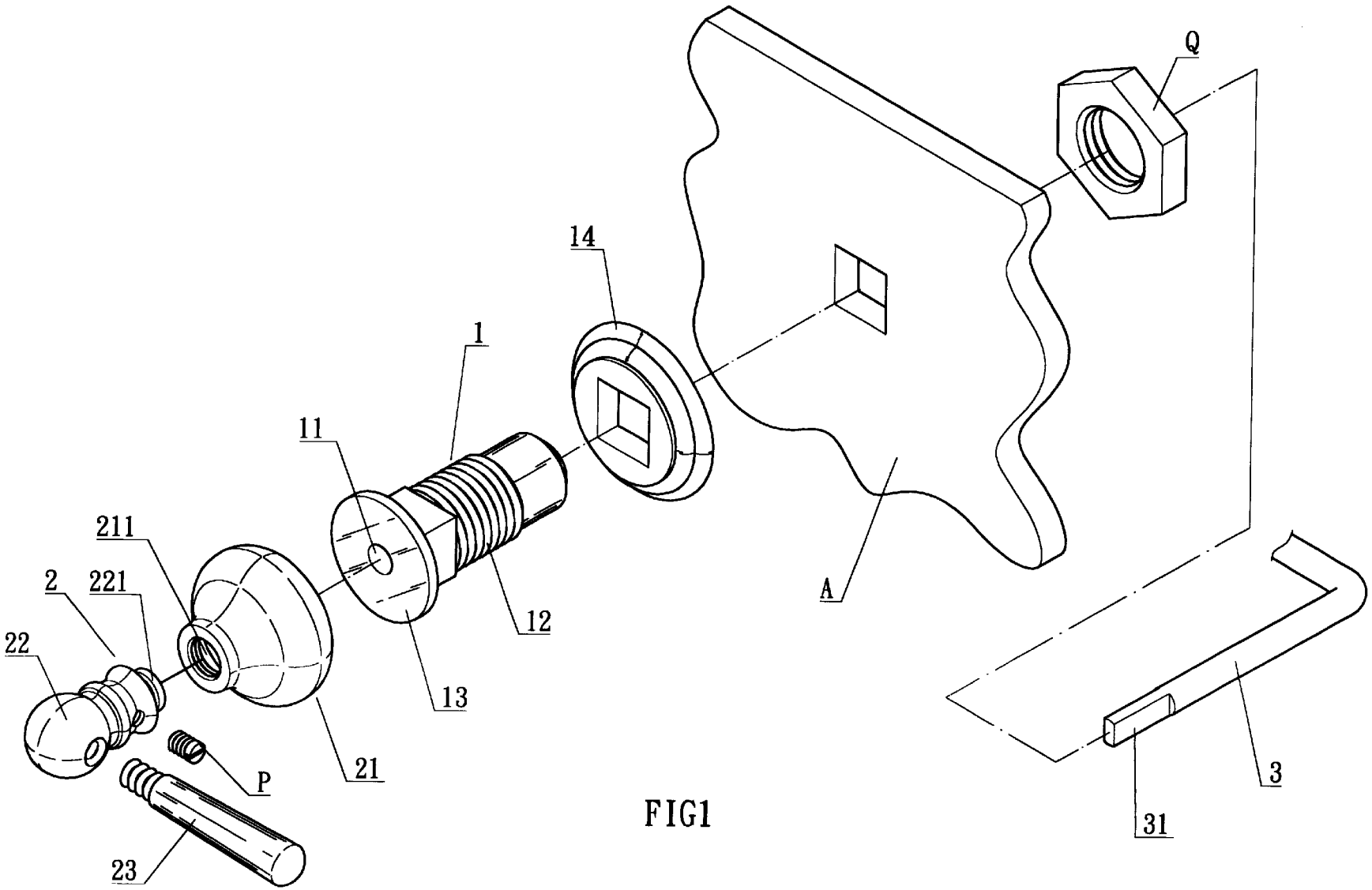
FIG. 1 is an exploded drawing of the invention herein.
Figure 2:
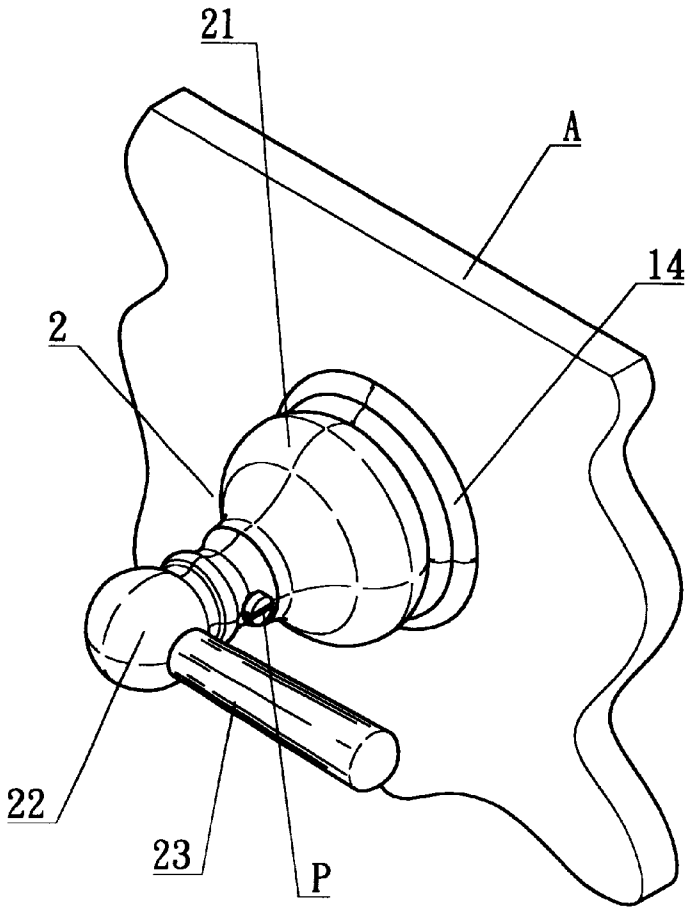
FIG. 2 is an isometric drawing of the invention herein.
Figure 3:
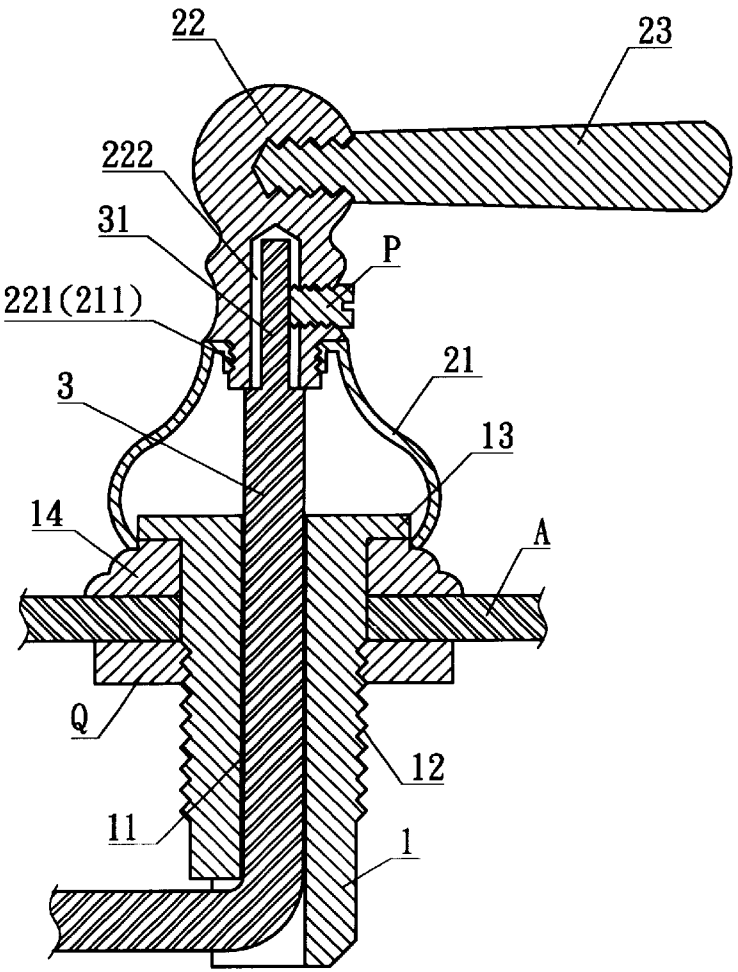
FIG. 3 is a cross-sectional drawing of the invention herein.

Referring to FIGS. 1–3, the structural arrangement of the invention herein is comprised of a base mount 1 installed onto the side wall of a cistern, a pressure control seat 2 assembled to the front end of the base mount 1, and a stem 3 inserted through the base mount 1 and fixed at the front end of the pressure control seat 2.

The base mount 1 is a T-shaped anchoring structure having a passage 11 disposed through the center, the passage 11 providing for the insertion of the stem 3. Threads 12 are formed along the minor cylindrical surface of the base mount 1 and a flanged end 13 is formed at the extremity of the major cylindrical surface and situated to maintain a colored decorative piece 14 against the side wall A of the cistern tank. A nut Q is fastened onto the threads 12 of the base mount 1 inside the cistern tank to secure the base mount 1 and the colored decorative piece 14 to the side wall A of the cistern tank.

The pressure control seat 2 consists of a sleeve fitting 21 affixed onto the base mount 1, an end cap 22 fastened to the front end of the sleeve fitting 21, and a flushing handle 23 fastened to the side of the end cap 22.

The sleeve fitting 21 is a hollow structure having a recess at one end and threaded hole 211 in the opening at the opposite end, with the threaded hole 211 axially aligned with the passage 11 of the base mount 1 to provide for the insertion of the stem 3.

The end cap 22 has a male threaded section 221 along its bottom end that is fastened into the threaded hole 211 of the sleeve fitting 21. The end cap 22 has disposed in it a center hole 222 that is aligned with the threaded hole 211 of the sleeve fitting 21 to provide for the insertion of the stem 3 through the passage 11 of the base mount 1, the threaded hole 211 of the sleeve fitting 21, and the center hole 222 of the end cap 22, respectively. A set screw P is fastened into the lateral wall of the end cap 22 and tightened against the stem 3 to thereby secure it onto the stem 3.

The stem 3 is an L-shaped rod-like structure having an angled shorter section situated against the bottom edge of the base mount 1. A flat end 31 is formed at the portion of the stem 3 that is inserted into the center hole 222 of the end cap 22 to provide for the firm bottoming and fastening of the set screw P.

Referring to FIG. 3, the cross-sectional drawing of the invention herein that illustrates its assembly, the square hole of the colored decorative piece 14 is placed over the square section of the base mount 1, the flanged end 13 formed at its major cylindrical surface holds down the colored decorative piece 14 against the side wall A of the cistern tank and the nut Q is fastened onto the threads 12 of the base mount 1 inside the cistern tank to secure the base mount 1 and the colored decorative piece 14 to the side wall A of the cistern tank. The stem 3 is then inserted through the passage 11 of the base mount 1 and the portion of the stem 3 protruding from the base mount 1 is inserted into the hollow sleeve fitting 21. The end cap 22 is fastened to the front end of the sleeve fitting 22 such that the flat end 31 of the stem 3 is positioned inside the center hole 221 of the end cap 22. Finally, the set screw P is fastened from the outer edge of the end cap 22 such that the lower tip of the set screw P is against the flat end 31 of the stem 3 to thereby secure the sleeve fitting 21 and the end cap 22 at the front end of the base mount 1.

Referring to FIG. 4-A and FIG. 4-B, the drawings of two other embodiments of the invention herein, a male threaded surface 131 is formed along the outer edge of the base mount 1 flanged end 13 and a female threaded surface 141 is formed along the inner edge of the colored decorative piece 14. The female threaded surface 141 is first fastened onto the flanged end 13 of the base mount 1 and then the stem 3 is inserted, following which the pressure control seat 2 is secured to the front end of the colored decorative piece 14. In FIG. 4-B, a female threaded surface 132 is disposed along the center recess of the base mount 1 flanged end 13 and a male threaded surface 142 is formed along the projecting inner edge of the colored decorative piece 14 and aligned with the female threaded surface 132, then the stem 3 is inserted and the pressure control seat 2 is secured to the front end of the colored decorative piece 14.

What is claimed is:

1. A cistern handle comprising: a base mount adapted to be installed onto a side wall of a cistern, a colored decorative piece, a pressure control Seat assembled to a front end of the base mount, and a stem inserted through the base mount and fixed at the front end of the pressure control seat, in which:

the base mount is a T-shaped anchoring structure having threads formed along a minor cylindrical surface and a flanged end formed at an extremity of its major cylindrical surface, the flanged end engaging the colored decorative piece to hold the colored decorative piece against the side wall of a cistern tank and a nut is fastened on the threads;

the pressure control seat including a sleeve fitting affixed onto the base mount, an end cap fastened at a front end of the sleeve fitting, and a flushing handle fastened to the end cap, the sleeve fitting being a hollow structure having a recess at one end and a threaded hole in an opening at an opposite end, the threaded hole being axially aligned with a passage of the base mount to provide for the insertion of the said stem, the end cap having a male threaded section fastened into the sleeve fitting and a center hole that is aligned with the threaded hole of the said sleeve fitting;

the stem is an L-shaped rod with an angled shorter section situated against a bottom edge of the base mount and a flat end formed on a portion of the stem that is inserted into the center hole of the said end cap, the stem being inserted through the passage of the base mount, the threaded hole of the said sleeve fitting, and the center hole of the end cap, respectively; and a set screw is fastened into a lateral wall of the end cap and tightened against the stem to secure the end cap onto the stem.

2. The cistern handle of claim 1 further comprising a second male threaded section formed on an outer edge of the major cylindrical surface of the base mount and a female threaded surface formed along an inner edge of the colored decorative piece and engaged by the second male threaded section whereby the pressure control seat is secured to the colored decorative piece.

3. The cistern handle of claim 1 further comprising a female threaded surface formed in a center recess of the major cylindrical surface of the base mount and a second male threaded surface formed along a projecting inner edge of the colored decorative piece and engaged with the female threaded surface whereby the pressure control seat is secured to the colored decorative piece.

* * * * *